US007213541B2

(12) United States Patent
Powell et al.

(10) Patent No.: US 7,213,541 B2
(45) Date of Patent: May 8, 2007

(54) STEAM GENERATING METHOD AND APPARATUS FOR SIMULATION TEST CHAMBERS

(75) Inventors: Richard M. Powell, Linden, PA (US); Bruce W. Hess, Benton, PA (US)

(73) Assignee: Lunaire Limited, Williamsport, PA (US)

( * ) Notice: Subject to any disclaimer, the term of this patent is extended or adjusted under 35 U.S.C. 154(b) by 206 days.

(21) Appl. No.: 10/651,050

(22) Filed: Aug. 29, 2003

(65) Prior Publication Data

US 2005/0072383 A1 Apr. 7, 2005

(51) Int. Cl.
*F22G 1/28* (2006.01)

(52) U.S. Cl. ..... 122/483; 392/401; 392/451; 122/36

(58) Field of Classification Search ..... 122/483, 122/486, 494, 367.1, 505, 506, 36, 20 R; 392/401, 451, 453, 455, 327, 322, 424, 456, 392/501

See application file for complete search history.

(56) References Cited

U.S. PATENT DOCUMENTS

| | | | | | |
|---|---|---|---|---|---|
| 1,866,221 | A | | 7/1932 | Pennington | |
| 3,291,964 | A | * | 12/1966 | Williams | 392/401 |
| 3,874,365 | A | * | 4/1975 | Pava | 126/263.01 |
| 4,051,345 | A | | 9/1977 | Eaton | 219/288 |
| 4,052,587 | A | | 10/1977 | Eaton | 219/295 |
| 4,101,758 | A | | 7/1978 | Sprague | 219/288 |
| 4,109,137 | A | | 8/1978 | Zabelka | 219/285 |
| 4,121,090 | A | | 10/1978 | Kuenzli | 219/284 |
| 4,169,558 | A | | 10/1979 | Coates | 239/553.5 |
| 4,206,342 | A | | 6/1980 | Kuenzli | 219/284 |
| 4,314,139 | A | | 2/1982 | Williams et al. | 219/285 |
| 4,322,603 | A | | 3/1982 | Bright | 219/278 |
| 4,377,737 | A | * | 3/1983 | Berry | 392/401 |
| 4,532,412 | A | | 7/1985 | Birocchi | 219/271 |
| 5,020,128 | A | * | 5/1991 | Bleckmann | 392/498 |
| 5,063,609 | A | | 11/1991 | Lorimer | 392/401 |
| 5,188,020 | A | | 2/1993 | Buchnag | 99/468 |
| 5,195,502 | A | * | 3/1993 | Hanning | 122/18.3 |
| 5,305,415 | A | | 4/1994 | Stevens | 392/403 |
| 5,339,897 | A | | 8/1994 | Leaute | 166/245 |
| 5,367,605 | A | * | 11/1994 | Violi | 392/401 |
| 5,440,668 | A | * | 8/1995 | Jones | 392/327 |

(Continued)

FOREIGN PATENT DOCUMENTS

| | | |
|---|---|---|
| FR | 1154352 | 4/1958 |

(Continued)

*Primary Examiner*—Gregory Wilson
(74) *Attorney, Agent, or Firm*—Baker & Hostetler LLP

(57) ABSTRACT

A method and apparatus for providing steam for a test chamber is provided. The apparatus includes a heating element contained within a vessel which is fluid communication with an exterior reservoir wherein the heating element provides heat to generate steam from the water entering the vessel from the reservoir. The method for generating steam includes providing a chamber configured to contain a fluid insetting water into the chamber from a reservoir external from the chamber, controlling an amount of water inlet into the reservoir substantially equalizing the water level in the reservoir with the water level in the chamber. The method also includes heating the water in the chamber to turn at least some of the water into steam and venting at least some of the steam out of the chamber.

12 Claims, 6 Drawing Sheets

U.S. PATENT DOCUMENTS

| | | | | |
|---|---|---|---|---|
| 5,467,424 | A * | 11/1995 | Davies et al. | 392/401 |
| 5,732,858 | A | 3/1998 | Plastino | 233/12 |
| 5,915,071 | A * | 6/1999 | Harbin, III | 392/401 |
| 5,950,820 | A | 9/1999 | Heinze, IIII | 206/232 |
| 6,021,931 | A | 2/2000 | Plastino | 233/12 |
| 6,078,729 | A * | 6/2000 | Kopel | 392/402 |
| 6,167,845 | B1 * | 1/2001 | Decker, Sr. | 122/40 |
| 6,237,469 | B1 | 5/2001 | Stritzl et al. | 99/330 |
| 6,393,212 | B1 * | 5/2002 | Hutchinson | 392/491 |
| 6,445,880 | B1 * | 9/2002 | Hollander et al. | 392/485 |
| 6,577,815 | B1 | 6/2003 | Wu | 392/402 |
| 2005/0141889 | A1 * | 6/2005 | Laing | 392/322 |

FOREIGN PATENT DOCUMENTS

| | | |
|---|---|---|
| FR | 2680224 | 2/1993 |

* cited by examiner

STEAM GENERATING METHOD AND APPARATUS FOR SIMULATION TEST CHAMBERS

FIELD OF THE INVENTION

The present invention relates generally to steam generators. More particularly, the present invention relates to steam generators for use in test ovens and other industrial test chambers.

BACKGROUND OF THE INVENTION

Simulation test chambers are chambers designed to replicate certain environmental conditions. Objects are placed in the chambers and are evaluated to see how well the object performs under certain conditions. A test chamber may be refrigerated to cold temperatures or may be heated to certain high temperatures. Along with the temperature, humidity is also controlled to see how an object performs under various humid conditions.

In order to provide humidity for a test chamber, a steam generator is often used. In some steam generators, steam is generated by applying water to a heating element. The heating element boils the water and generates steam. Not supplying enough water to the heating element can cause a multitude of problems, including not generating the proper amount of steam and also other problems associated with overheating the heating element.

Other problems associated with current steam generators are that valves and other moving parts which may contribute to the control and/or operation of the steam generator may be located in hard to access areas. Locating moving parts that need servicing in hard to access areas may increase the difficulty of servicing and/or manufacturing the steam generator. Other problems with some known steam generators are that they have complex designs which result in high manufacturing costs.

Another problem associated with some steam generators is that they are hard to clean and service. Additionally, they may not easily allow water to be drained from them in order to flush sediment and other types of build-up that occur within the steam generator.

Accordingly, it is desirable to provide a steam generator and method of generating steam that uses a steam generator of a simplified design and is less expensive to manufacture that prior art generators. It is desirable to provide a method and apparatus for generating steam that locates the valves and other moving parts in easy to access locations to simplify service of the steam generator. It is also desirable to provide a method and apparatus for generating steam that provides a steam generator that allows for simplified cleaning and flushing the system to remove sediment and other types of buildup.

SUMMARY OF THE INVENTION

The foregoing needs are met, to a great extent, by the present invention, wherein in one aspect an apparatus is provided that in some embodiments provides a steam generator of a simplified design that locates the valves and other moving parts associated with a steam generator in easy to access location and that allows for simplified cleaning and flushing the system to remove sediment and other types of buildup.

In accordance with one embodiment of the present invention, a steam generator is provided. The steam generator includes a housing, a tubular vessel located within the housing, a heating element located within the tubular vessel, a water inlet configured to allow water to enter the tubular vessel, and a steam outlet configured to outlet steam from the tubular vessel and housing.

In accordance with another embodiment of the present invention, a steam generator is provided. The steam generator includes a housing, a steam chamber located within the housing, a heating element located within the steam chamber, a water inlet configured to allow water to enter the steam chamber, a steam outlet configured to outlet steam from the steam chamber and housing. The steam generator also includes a vessel located external to the steam chamber having an interior reservoir in fluid communication with the steam chamber such that a liquid level in the reservoir and a liquid level in the steam chamber will seek to achieve substantially the same level, and a valve associated with the vessel configured to regulate a liquid flow from an external source into the reservoir to achieve a desired liquid level in the reservoir.

In accordance with yet another embodiment of the present invention, a steam generator is provided. The steam generator includes means for containing a fluid, means for converting water to steam located in the containing means, means for inletting water into the containing means located on the containing means, means for outletting a fluid from the containing means located on the containing means and means for storing water located outside the containing means in fluid communication with the containing means and configured to store water at a level approximately equal to a level of water in the storing means.

In accordance with still another embodiment of the present invention, a method of generating steam is provided. The method includes the steps of providing a chamber configured to contain a fluid, inletting water into the chamber from a reservoir external from the chamber, controlling an amount of water let into the reservoir, substantially equalizing a water level in the reservoir with a water level in the chamber, heating the water in the chamber to turn at least some of the water into steam, and venting at least some of the steam out of the chamber.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
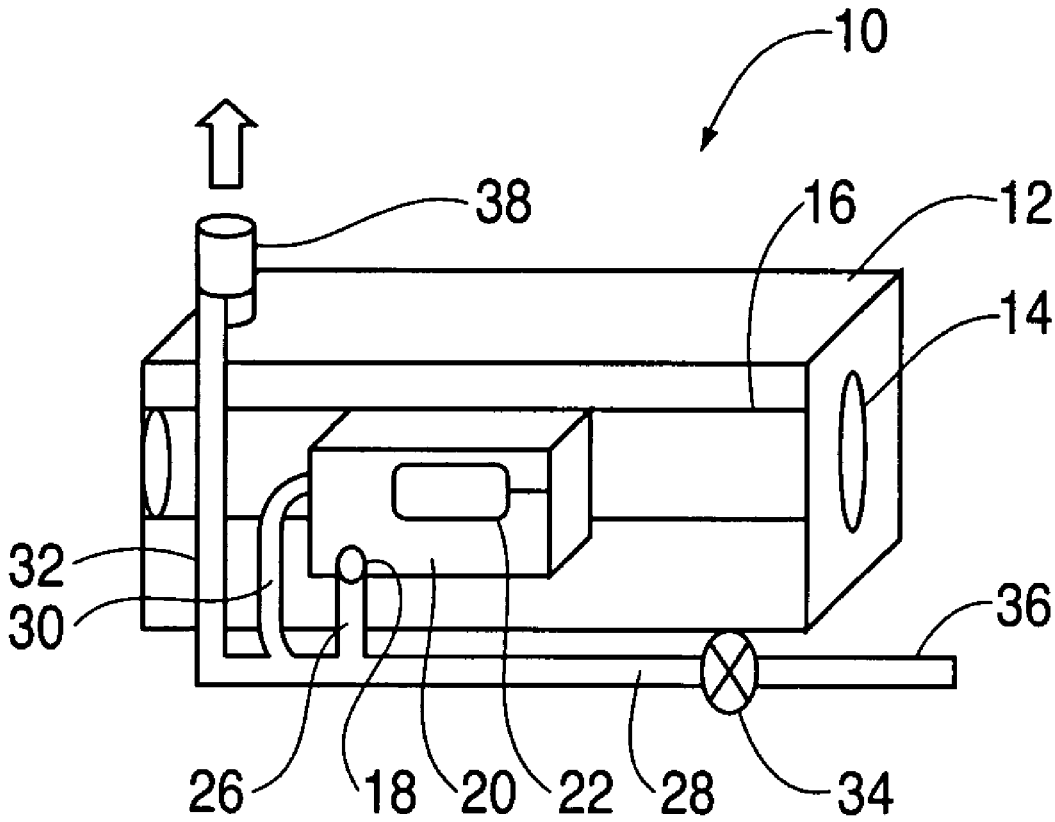
FIG. 1 is a perspective view of simplified schematic of a steam generator according to a preferred embodiment of the present invention.

The invention will now be described with reference to the drawing figures in which like reference numerals refer to like parts throughout. An embodiment in accordance with the present invention provides a steam generator having a tubular evaporator that is easily removed from the steam generator. Water is inlet to the evaporator where a heating element heats the water to steam. The steam is then vented out of the evaporator and steam generator. The valves for controlling water flow and other moving parts associated with the steam generator are located in a side box that is easily accessed. The easy access features provide, among other things, ease of maintenance.

It is understood that the term water as used herein is not limited to pure $H_2O$ only, but includes water and impurities often found in tap water and other water sources. The term water includes water having any trace impurities.

Turning now to the drawings, an embodiment of the present inventive apparatus is illustrated in FIG. 1. FIG. 1 is a simplified schematic view of a steam generator 10, in accordance with a preferred embodiment of the present invention. The steam generator 10 has a housing 12. On one end of the housing 12 is a port 14 which allows the steam vessel 16 (also referred to as an evaporator tube) to be inserted into the housing 12. Exterior to the housing 12 is a box housing 18. The box housing 18 houses a water reservoir 20 and water level float valve 22. The water level float valve 22 permits water to enter into the reservoir 20 through a reservoir inlet 24 (see FIG. 8), which receives water from an external water source. The float valve 22 permits water to enter into the water reservoir 20 until the water level in the reservoir 20 achieves a certain predetermined level. Once the water level is in the reservoir 20 reaches the predetermined level, the float valve 22 will shut off the water flow from the inlet 24.

The water reservoir 20 is in fluid communication with the interior of the steam vessel 16 through pipes 26, 28 and 30. The water level within the water reservoir 20 will, in some embodiments of the present invention, seek to equalize with the water level within the steam vessel 16. The piping system for the steam generator 10 includes, at least in part, main pipe 28, the reservoir outlet pipe 26, a steam vessel inlet pipe 30, and an overflow pipe 32. Pipes 26, 30 and 32 are all in fluid communication with the main pipe 28. A drain valve 34, is located at a low point in the piping system and separates main pipe 28 from drain pipe 36. The drain valve 34 permits water to be drained from the piping system to a drain pipe 36 which can be connected to an outside drainage system in order to remove sediment and other types of buildup that may occur within the piping system.

A steam outlet 38 is located on the housing 12 and is in fluid communication with the interior of the steam vessel 16. The steam outlet 38 permits the steam generated within the steam vessel 16 to be exited from the steam vessel 16 and out of the steam generator 10. An overflow pipe 32 connects the steam outlet 38, to the reservoir 20 to provide a relief in case of an overpressure condition within the steam vessel 16 due to a clogged steam line and unvented chamber or some other problem.

Figure 2:
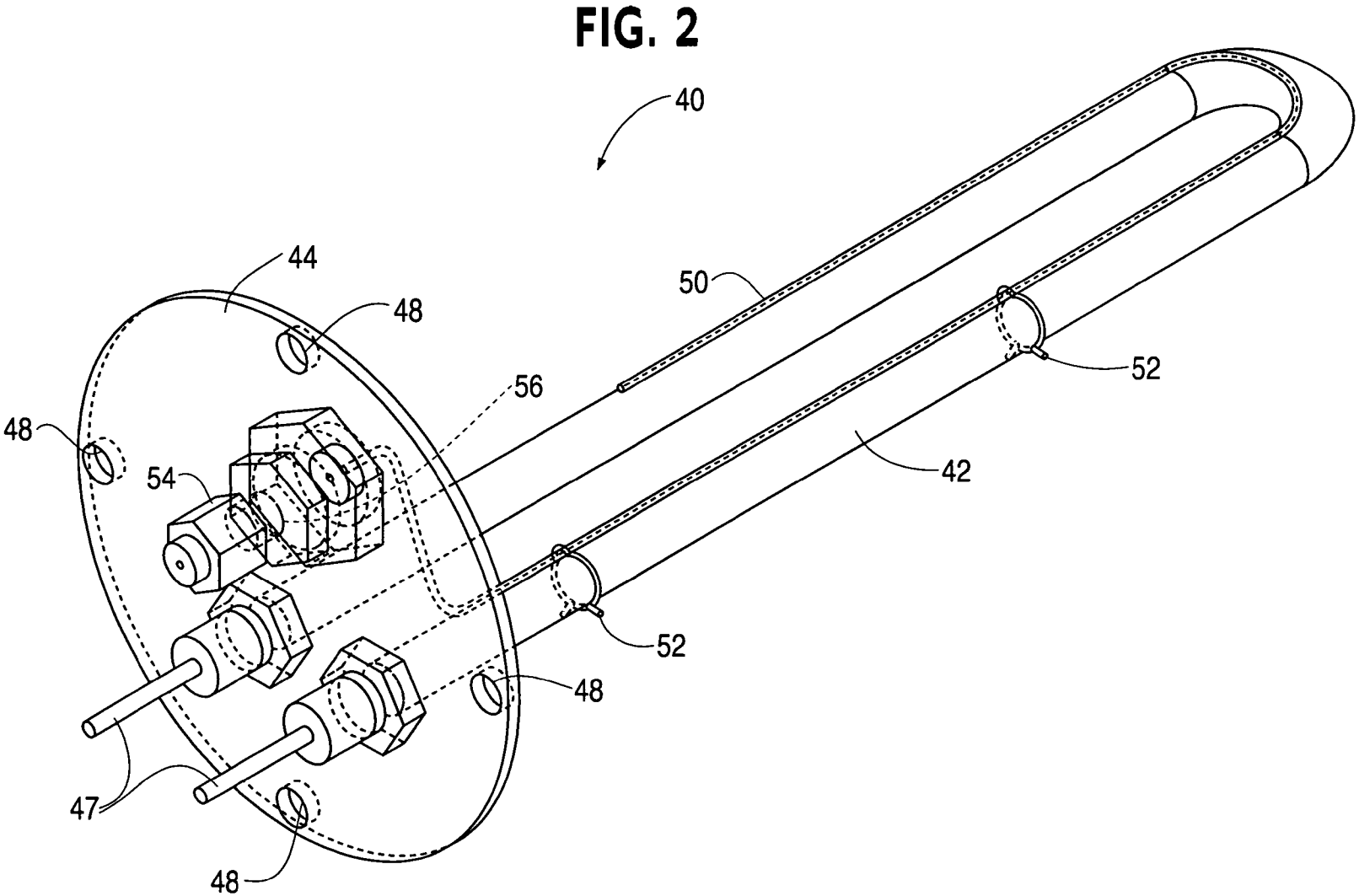
FIG. 2 is a detailed perspective view of a heating element in accordance with one embodiment of the present invention.

FIG. 2 is a detailed perspective view of an immersion heater associated with the steam generator 10. The immersion heater 40 includes an immersible heating element 42 that is submerged in water and boils the surrounding water to generate steam. The immersion heater 40 is connected to an end plate 44 by bolts 46 (shown in FIG. 3). Other types of fasting means may be use in accordance with the invention. Extending through the end plate 44 are electrical plugs 47 which communicate with an external electrical system which activates the heating element 42. The heating element 42 in some embodiments of the invention is preferably a 1,500 watt heating element.

Attached to the heating element 42 is a thermostat 50. As shown in FIG. 2, the thermostat 50 is connected to the top of the heating element 42, preferably by stainless steel clips 52. Some embodiments of the invention will use several more clips than shown in FIG. 2. The thermostat 50 monitors the temperature of the heating element 42. The thermostat 50 is attached to the top of the heating element 42 because if the water level in the steam vessel 16 should drop, the top of the heating element 42 will be exposed above the water level first and therefore will be the most likely portion of the heating element to overheat. The thermostat 50 is operatively connected to the heating element 42 so that when the heating element 42 achieves an unacceptably high temperature, the thermostat 50 will shut off power or turn off the heating element 42.

The thermostat 50 is an automatically setting type and automatically allows the heating element 42 to turn back on when the temperature of the heating element 42 achieves an acceptable temperature. In a preferred embodiment of the present invention, the thermostat 50 is set to trigger the turnoff of the heating element 42 when the heating element 42 achieves a temperature slightly above the boiling point of water.

The thermostat 50 flows through the end plate 44 through a capillary tube 54 which goes through a compression fitting 56 which is configured to not allow steam to escape through the path through the end plate made followed by the thermostat 50. On the end plate 44 are bolt holes 48 which permit the mounting of the immersion heater 40. In other embodiments of the invention, the immersion heater 40 may be mounted by other suitable means.

Figure 3:
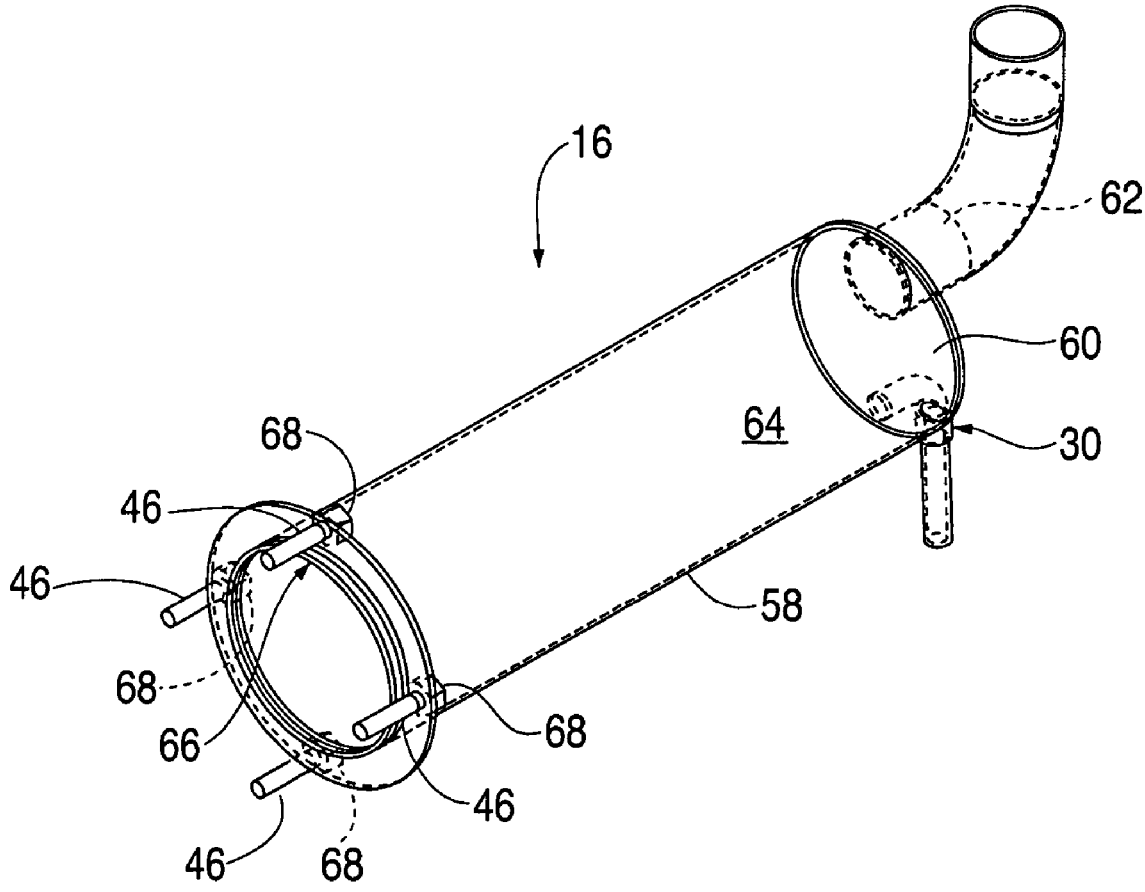
FIG. 3 is a detailed perspective view of an evaporator tube assembly portion of a steam generator.

FIG. 3 is a perspective view of the steam vessel 16 also known as the evaporator tube 16. The evaporator tube 16 includes an evaporator tube housing 58 which is preferably a generally tubular shape. At one end of the tube is a plate 60. A steam vent pipe 62 is connected to the plate 60 and is put in fluid communication with the interior of the evaporator tube 16. Through the steam vent pipe 62, steam generated within the evaporator tube 16 exits the steam generator tube 58 and out of the steam generator 10.

The water inlet 64 allows water to flow through the inlet pipe 30 through the plate 60 into the tube housing 58. The evaporator tube housing 58 is open on the other end and has a flange 66 with holes 68 in it to allow bolts 46 to extend through the flange 66 and through the holes 48 in the end plate 44 shown in FIG. 2. Nuts are attached to the bolts 46 and connect the immersion heater 40 with the flange 66.

Figure 4:
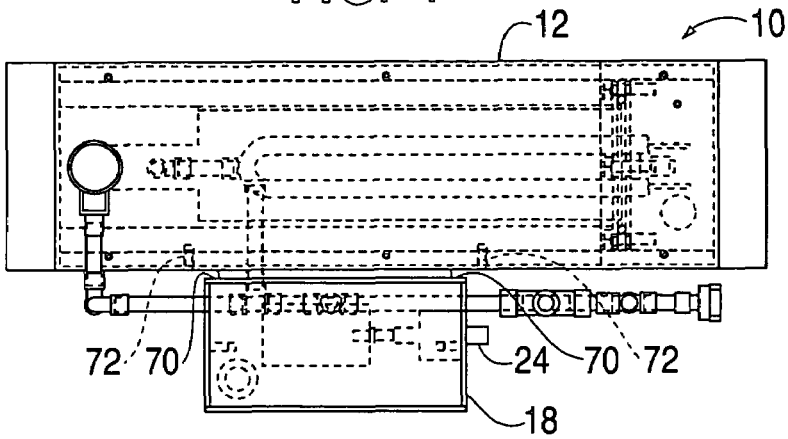
FIG. 4 is a detailed top view of a steam generator.

FIG. 4 is the detailed top view of steam generator 10. The exterior box housing 18 is attached to the steam generator housing 12 by mounting brackets 70 held in place with screws 72. Other embodiments of the invention may include attaching the exterior box housing 18 to the steam generator housing 12 by other suitable means.

Figure 5:
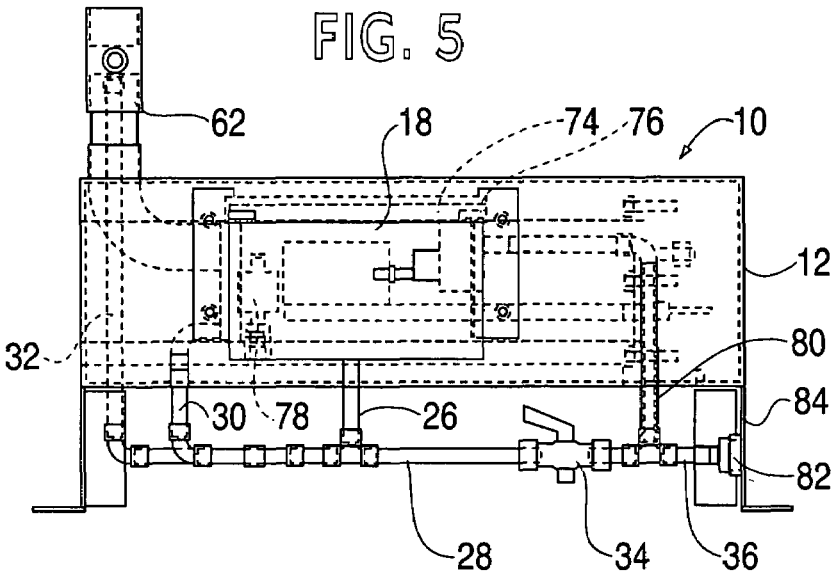
FIG. 5 is a detailed side view of a steam generator.

FIG. 5 is a detailed side view of the steam generator 10. The exterior box housing 18 has a lid 74 which is removable and provides access to the valves and other components within the box housing 18. The lid 74 is held onto the box housing 18 by lid screws 76. Other embodiments of the invention may include a hinged box housing lid 74 or other types of fasteners that attach the lid 74 to the box housing 18.

Optionally, contained within the box housing 18 (as shown in FIG. 5) is a valve 78. This optional valve 78 is an electronic float sensor. In some embodiments of the invention, the valve 78 may be used as a redundant heater element safety to shut off the heater element in the water level is too low. In addition, the valve 78 may be used as a switch to turn on an external water pump when the water level gets too low. In some embodiments of the invention, this valve 78 is an electronic GEM (G.E.M.) valve. Some embodiments of the invention will use the valve 78 in addition to the mechanical float valve 22, other embodiments may not use the valve 78 but still use the mechanical float valve 22 shown in FIGS. 1 and 8 to regulate water entering the box housing 18.

Water exits the box housing 18 by an exit pipe 26 which attaches to the main pipe 28. The housing exit pipe 26 is in fluid communication with the steam vessel inlet pipe 30 via the main pipe 28. Because water can flow freely between the interior of the box housing 18 and the interior of the evaporator tube 16, the water level contained within the box housing 18 and the water level contained within the evaporator tube 16 will seek to equalize and achieve a common level. Therefore, adjusting the height of the box housing 18 achieves a desired fluid level within the evaporator tube 16.

Once the water is turned to steam within the steam evaporator tube 16, the steam it may exit by the steam vent pipe 62. Attached to the steam vent pipe 62 is an overflow pipe 32 which is attached to a top portion of the steam vent pipe 62 and provides an overflow in case steam or water need to escape the evaporator tube 16. The overflow pipe 32 puts the vent pipe 62 in fluid communication with the main pipe 28.

A reservoir overflow pipe 80 is also shown in FIG. 5 and puts the reservoir 20 contained in the box housing 18 within fluid communication with the drain pipe 36. At the end of drain pipe 36 is a fitting 82 which permits the drain pipe 36 to be attached to a drainage system. The drain pipe 36 is downstream from the valve 34 and unlike the main pipe 28 that can be blocked by valve 34, the drain pipe 36 has free access to exit the steam generator 10.

A support bracket 84 supports the steam generator housing 12 and provides a means for mounting the steam generator 10 to a desired mounting surface. In the embodiment of the invention shown in FIG. 5, the mounting bracket 84 is attached to a bottom portion of the steam generator housing 12. In other embodiments of the invention, the mounting brackets 84 may be mounted to top side or end portions of the steam generator housing 12.

Figure 6:
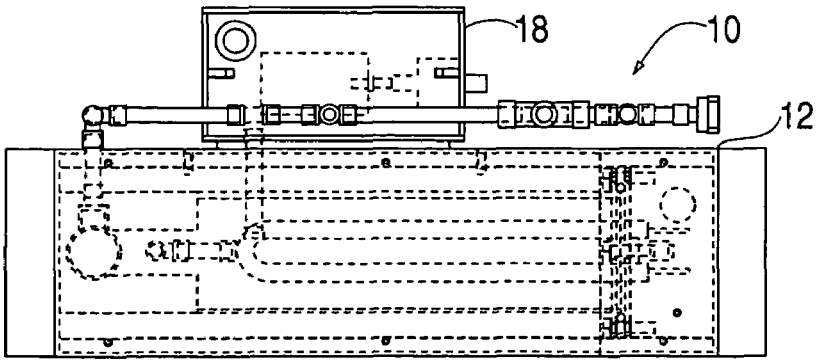
FIG. 6 is a detailed bottom view of a steam generator.

FIG. 6 is a detailed bottom view of the steam generator 10 showing the exterior box housing 18 attached to the steam generator housing 12.

Figure 7:
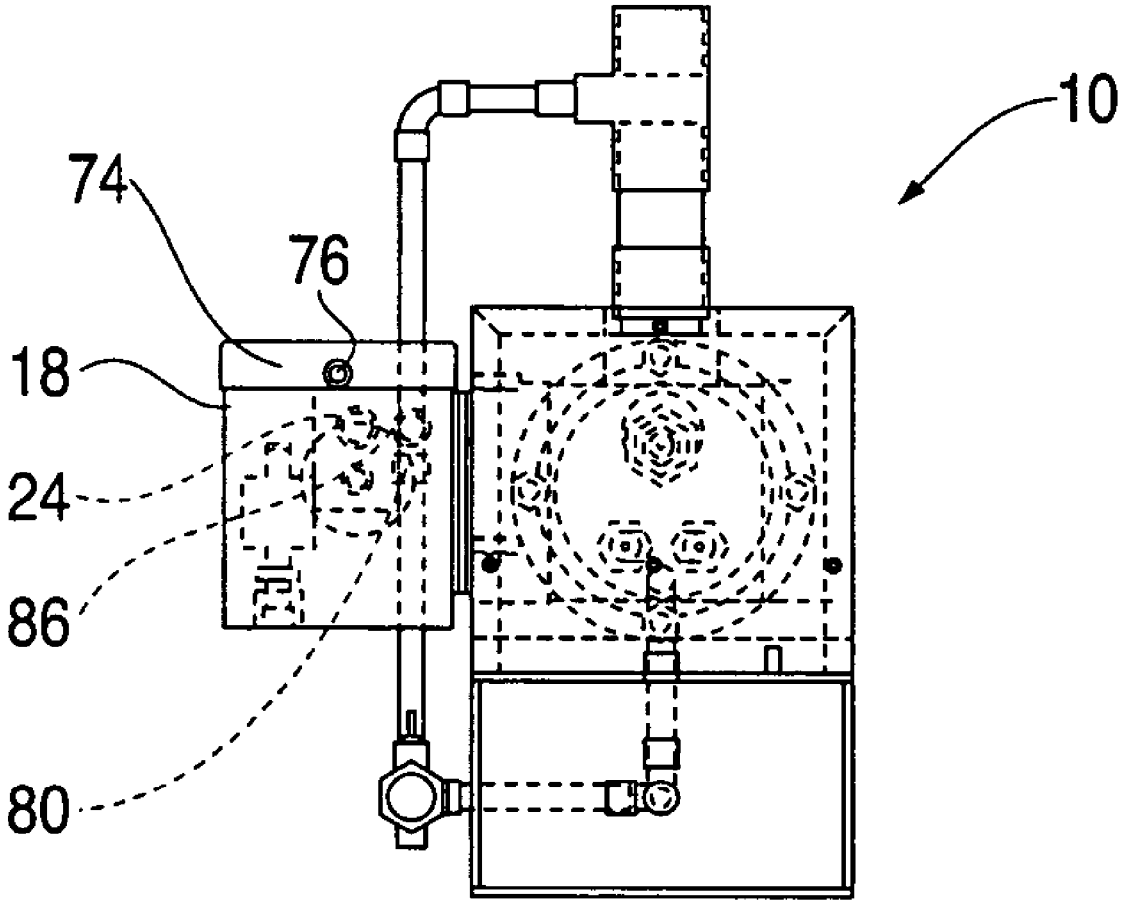
FIG. 7 is a detailed end view of a steam generator.

FIG. 7 is a detailed end view of the steam generator 10. The exterior box housing 18 is shown with a lid 74 and the lid screw 76 attaching the lid 74 to the box housing 18. Also shown is the reservoir inlet 24 which permits water to be inlet into the box housing 18. Also shown is the outlet 86 from the box housing to which the box housing overflow pipe 80 is attached. The outlet 86 is mounted at a height selected in order to allow the steam generator 10 to work properly without causing the reservoir 20 contained within the box housing 18 to overflow.

Figure 8:
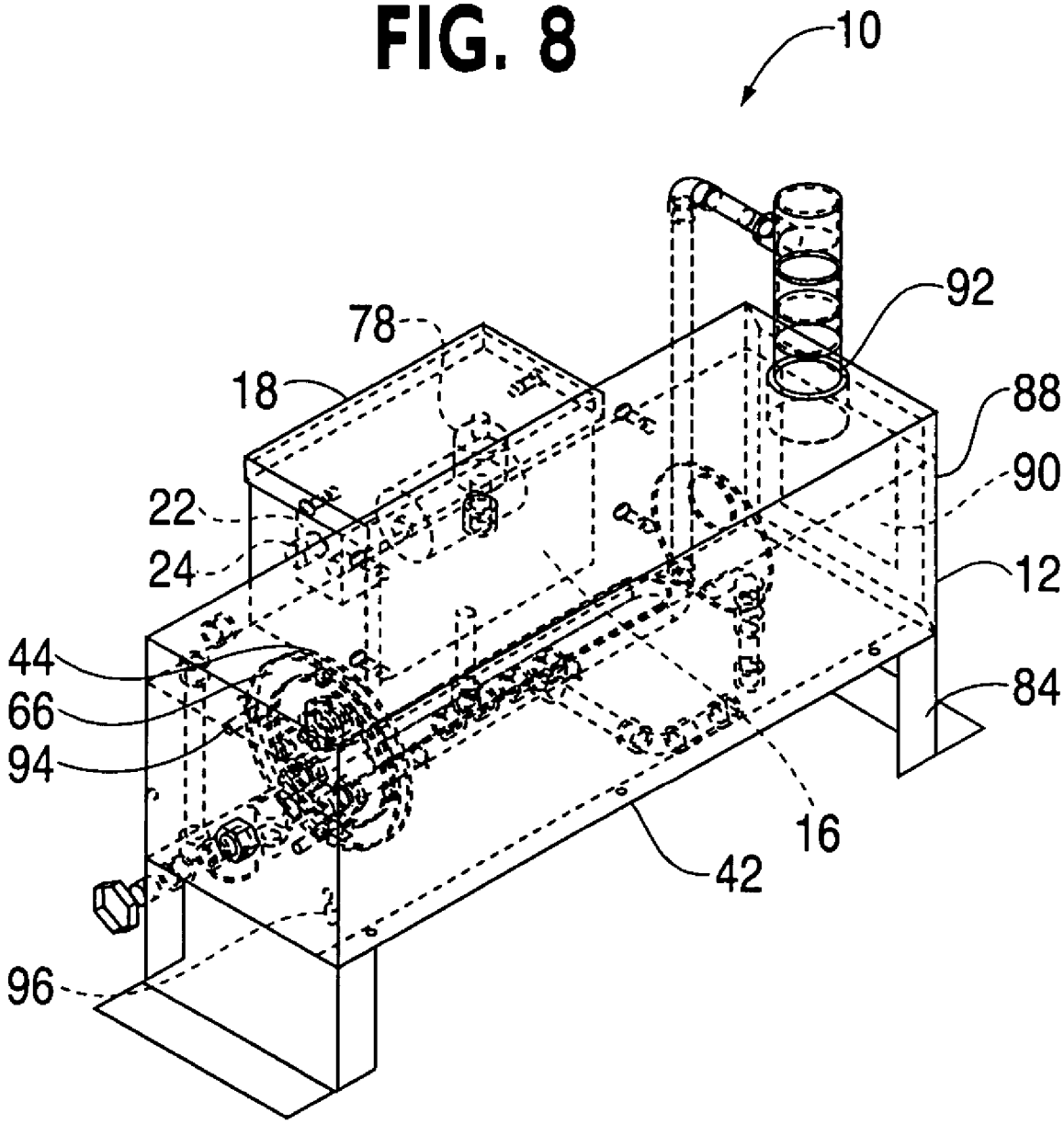
FIG. 8 is a detailed, perspective view of a steam generator.

FIG. 8 is a detailed perspective view of the steam generator 10 mounted on the mounting brackets 84. The steam generator 10 includes insulation sides 88, a dense board 90 and insulation top 92, which, in combination, provide insulating properties to the steam generator 10 to reduce the amount of heat the heating element 42 must provide in order to generate steam.

FIG. 8 also shows the float valve assembly 22 contained within the box housing 18 and the water inlet 24 to the box housing 18.

An O-ring 94, which may be made from silicone, provides a seal between the end plate 44 and the flange 66, when the immersion heater 40 is installed within the evaporator tube 16.

A steel grounding stud 96 provided on the housing 12 of the steam generator 10. The grounding stud 96 provides a ground to which electric components, such as the optional GEM switch 78 and/or the electric heating element 42 may be grounded. The grounding stud 96 is connected to a grounding wire connected to ground. In some embodiments of the invention, the grounding wire connected to the grounding stud 96 is separate from the main ground associated with the chamber in which the steam generator 10 is placed.

Although an example of the steam generator is shown and described herein for use in test chambers, a steam generator in accordance with the invention can be used in any setting where steam and/or humidity is desired.

While the description herein has been directed primarily to water and steam, the invention can be applied to other fluids capable of achieving a gas and liquid form. For example other fluids may be used if desired, to test objects in environments comprising gases other than steam if gases other than steam are desired to be generated.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A steam generator comprising:

a housing;

a tubular vessel located within the housing;

a heating element located within the tubular vessel;

a water inlet configured to allow water to enter the tubular vessel;

a steam outlet configured to outlet steam from the tubular vessel and housing; and a thermostat configured to monitor a temperature associated with the heating element and further configured to turn off the heating element when the heating element reaches a predetermined temperature, wherein the thermostat automatically turns back on the heating element when the temperature associated with the heating element goes below a predetermined temperature.

2. The steam generator of claim 1, wherein the predetermined temperature is slightly above the boiling point of water.

3. The steam generator of claim 1, wherein the thermostat senses the temperature associated with the heating element at a top portion of the heating element.

4. A steam generator comprising:

a housing;

a substantially rigid, generally tubular vessel located within the housing;

a heating element located within the tubular vessel;

a water inlet configured to allow water to enter the tubular vessel;

a steam outlet configured to outlet steam from the tubular vessel and housing; and an overflow pipe configured to drain at least one of water and steam from the tubular vessel when a pressure in the tubular vessel exceeds a predetermined limit.

5. A steam generator comprising:

a housing;

a tubular vessel located within the housing;

a heating element located within the tubular vessel;

a water inlet configured to allow water to enter the tubular vessel;

a steam outlet configured to outlet steam from the tubular vessel and housing;

an overflow pipe configured to drain at least one of water and steam from the tubular vessel when a pressure in the tubular vessel exceeds a predetermined limit; and a pressure sensor and a valve configured to sense a pressure within the tubular member and open the valve to provide fluid communication between an interior of the tubular member and an area outside the housing when the pressure exceeds the predetermined limit.

6. A steam generator comprising:

a housing;

a tubular vessel located within the housing;

a heating element located within the tubular vessel;

a water inlet configured to allow water to enter the tubular vessel;

a steam outlet configured to outlet steam from the tubular vessel and housing; and an overflow pipe configured to drain at least one of water and steam from the tubular vessel when a pressure in the tubular vessel exceeds a predetermined limit, wherein the overflow pipe provides fluid communication between an interior of the tubular vessel and a reservoir located outside the housing.

7. A steam generator comprising:

a housing;

a tubular vessel located within the housing;

a heating element located within the tubular vessel;

a water inlet configured to allow water to enter the tubular vessel;

a steam outlet configured to outlet steam from the tubular vessel and housing;

an overflow pipe configured to drain at least one of water and steam from the tubular vessel when a pressure in the tubular vessel exceeds a predetermined limit; and a variable mounting bracket configured to attach to the housing at any two of a bottom, side, end, and top portion of the housing and further configured to attach to a mounting surface for mounting the steam generator.

8. A steam generator comprising:

a housing;

a tubular vessel located within the housing;

a heating element located within the tubular vessel;

a water inlet configured to allow water to enter the tubular vessel; and a steam outlet configured to outlet steam from the tubular vessel and housing;

a reservoir external to the housing, but in fluid communication to the tubular vessel via the inlet by piping extending through the housing and connected to the inlet; and a float valve configured to regulate an amount of water coming into the reservoir, wherein the steam generator is located within a test chamber and configured to humidify the test chamber.

9. A steam generator comprising:

a housing;

a tubular vessel located within the housing;

a heating element located within the tubular vessel;

a water inlet configured to allow water to enter the tubular vessel;

a steam outlet configured to outlet steam from the tubular vessel and housing;

a reservoir external to the housing, but in fluid communication to the tubular vessel via the inlet by piping extending through the housing and connected to the inlet; and a float valve configured to regulate an amount of water coming into the reservoir.

10. The steam generator of claim 9, wherein the reservoir and tubular vessel are located with respect to each other to cause a water level both the reservoir and tubular to equalize with each other.

11. A steam generator comprising:

a housing;

a steam chamber located within the housing;

a heating element located within the steam chamber;

a water inlet configured to allow water to enter the steam chamber;

a steam outlet configured to outlet steam from the steam chamber and housing;

a vessel located external to the steam chamber having an interior reservoir in fluid communication with the steam chamber such that a liquid level in the reservoir and a liquid level in the steam chamber will seek to achieve substantially the same level; and a valve associated with the vessel configured to regulate a liquid flow from an external source into the reservoir to achieve a desired liquid level in the reservoir.

12. A steam generator comprising:

substantially rigid, generally tubular means for containing a fluid;

means for converting contained water to steam located in the containing means;

means for inletting water into the containing means;

means for outletting a fluid from the containing means located on the containing means; and means for storing water, at a level approximately equal to a level of water in the containing means located outside the containing means in fluid communication with the containing means.

* * * * *

UNITED STATES PATENT AND TRADEMARK OFFICE

CERTIFICATE OF CORRECTION

PATENT NO. : 7,213,541 B2
APPLICATION NO. : 10/651050
DATED : May 8, 2007
INVENTOR(S) : Richard M. Powell et al.

It is certified that error appears in the above-identified patent and that said Letters Patent is hereby corrected as shown below:

On the title page Item (57), Abstract
Line 8, replace "insetting" with --inletting--.

Signed and Sealed this

Third Day of July, 2007

JON W. DUDAS
*Director of the United States Patent and Trademark Office*